US012215930B2

(12) United States Patent
Wiedenhoefer

(10) Patent No.: US 12,215,930 B2
(45) Date of Patent: Feb. 4, 2025

(54) TUBE-IN-TUBE UNIFIED SHELL HEAT EXCHANGER

(71) Applicant: Raytheon Technologies Corporation, Farmington, CT (US)

(72) Inventor: James Fredric Wiedenhoefer, Windsor, CT (US)

(73) Assignee: RTX Corporation, Farmington, CT (US)

( * ) Notice: Subject to any disclaimer, the term of this patent is extended or adjusted under 35 U.S.C. 154(b) by 295 days.

(21) Appl. No.: 17/960,857

(22) Filed: Oct. 6, 2022

(65) Prior Publication Data

US 2024/0118034 A1 Apr. 11, 2024

(51) Int. Cl.

| | |
|---|---|
| ***F28D 7/12*** | (2006.01) |
| ***F28D 7/16*** | (2006.01) |
| ***F28D 21/00*** | (2006.01) |

(52) U.S. Cl.

CPC ..... *F28D 7/12* (2013.01); *F28D 21/0003* (2013.01); *F28D 7/1607* (2013.01); *F28D 2021/0026* (2013.01)

(58) Field of Classification Search

CPC ..... F28D 7/12; F28D 21/0003; F28D 7/1607; F28D 2021/0026; F28D 7/10; F28D 7/106; F28F 1/40

USPC ..... 165/156

See application file for complete search history.

(56) References Cited

U.S. PATENT DOCUMENTS

| | | | | |
|---|---|---|---|---|
| 2,341,319 A * | 2/1944 | Graham | F28D 7/026 29/890.048 |
| 2,937,855 A * | 5/1960 | Hazen | F28D 7/12 165/142 |
| 3,403,726 A * | 10/1968 | Jones | C21D 1/84 122/318 |
| 3,586,098 A * | 6/1971 | Wellensiek | F28D 7/12 165/142 |

(Continued)

FOREIGN PATENT DOCUMENTS

| | | |
|---|---|---|
| JP | 2630427 B2 | 7/1997 |
| RU | 2027969 C1 | 1/1995 |

(Continued)

OTHER PUBLICATIONS

European Search Report issued Feb. 6, 2024 in counterpart European Application No. 23201569.3.

*Primary Examiner* — Jon T. Schermerhorn, Jr.
(74) *Attorney, Agent, or Firm* — Bachman & LaPointe, P.C.

(57) ABSTRACT

A tube-in-tube unified shell element heat exchanger including an outer tube structure with an interior surface including an augmentation structure, an end cap and a flow outlet; an inner tube structure including a tubular shaped inner body defining an internal flow area, the inner tube structure including surface features formed on the exterior of the inner tube structure; the inner tube structure including a top ring connected to the exterior proximate an inlet port of the inner tube structure; inner tube structure includes an outlet port opposite the inlet port; wherein the top ring of the inner tube structure is connected with a top section of the outer tube structure; and a gap formed between the outer tube structure and the inner tube structure, the gap fluidly coupled between the inlet port and the flow outlet.

20 Claims, 13 Drawing Sheets

(56) References Cited

U.S. PATENT DOCUMENTS

| | | | | | |
|---|---|---|---|---|---|
| 3,887,003 | A * | 6/1975 | Polcer | F28F 9/0202 | 165/142 |
| 4,106,556 | A * | 8/1978 | Heyn | F28F 21/04 | 165/142 |
| 4,269,266 | A * | 5/1981 | Coates, Jr. | F28D 7/12 | 165/142 |
| 4,479,534 | A * | 10/1984 | Rhodes | F28D 7/12 | 165/142 |
| 4,548,257 | A * | 10/1985 | Williamson | F28B 9/10 | 165/142 |
| 4,694,864 | A | 9/1987 | Libin | | |
| 4,718,483 | A * | 1/1988 | Artusi | F28F 9/0229 | 165/142 |
| 5,269,133 | A | 12/1993 | Wallace | | |
| 6,139,315 | A * | 10/2000 | Berglund | C03B 5/237 | 165/142 |
| 8,590,604 | B2 | 11/2013 | Higashiyama et al. | | |
| 10,221,768 | B2 | 3/2019 | Agg | | |
| 2009/0166019 | A1 | 7/2009 | Tokizaki et al. | | |
| 2012/0222845 | A1 * | 9/2012 | Kinder | F28D 7/103 | 165/154 |

FOREIGN PATENT DOCUMENTS

| | | | |
|---|---|---|---|
| WO | 2019120980 | A1 | 6/2019 |
| WO | 2022150600 | A1 | 7/2022 |

* cited by examiner

TUBE-IN-TUBE UNIFIED SHELL HEAT EXCHANGER

BACKGROUND

The present disclosure is directed to tube-in-tube heat exchanger, particularly tube-in-tube unified shell heat exchanger.

Waste heat recovery heat exchangers are annular shaped, tube-style heat exchangers, situated aft of the turbine exit frame. Ideally, the operating fluid enters and exits from the outside diameter of that annulus, due to space constraints. The tubes are long and thin, but need to be rigid. Tubes must be allowed to thermally expand yet be constrained from excessive vibration.

What is needed is a tube-in-tube unified shell heat exchanger that allows simple assembly and plumbing, without the need of complex manifolds.

SUMMARY

In accordance with the present disclosure, there is provided a tube-in-tube unified shell element heat exchanger comprising an outer tube structure comprising a tube wall defining a first end opposite a second end; the outer tube structure comprises an interior surface and an exterior surface opposite the interior surface; the interior surface includes an augmentation structure; the outer tube structure comprises an end cap connected to the second end of the tube wall; the outer tube structure comprises a top section proximate the first end; the top section includes a flange and a flow outlet; the tube wall of the outer tube structure connects with the top section proximate the flange to form an integral outer tube structure; an inner tube structure including a tubular shaped inner body defining an internal flow area, the inner tube structure including surface features formed on the exterior of the inner tube structure; the inner tube structure including a top ring connected to the exterior proximate an inlet port of the inner tube structure; inner tube structure includes an outlet port opposite the inlet port; wherein the top ring of the inner tube structure is connected with the top section of the outer tube structure; and a gap formed between the outer tube structure and the inner tube structure, the gap fluidly coupled between the inlet port and the flow outlet.

A further embodiment of any of the foregoing embodiments may additionally and/or alternatively include the augmentation structure comprises helical shaped fins extending along the interior surface.

A further embodiment of any of the foregoing embodiments may additionally and/or alternatively include the surface features comprise external flutes that spiral along a portion of the length of the inner tube structure.

A further embodiment of any of the foregoing embodiments may additionally and/or alternatively include the augmentation structure along with the surface features are configured to provide vortex boundary mixing for an internal working fluid flowing between the exterior of the inner tube structure and interior surface of the outer tube structure.

A further embodiment of any of the foregoing embodiments may additionally and/or alternatively include the gap is configured for each of the inner tube structure and the outer tube structure to independently expand/contract responsive to thermal gradients.

A further embodiment of any of the foregoing embodiments may additionally and/or alternatively include the tube-in-tube unified shell element heat exchanger further comprising micro-fin surface features formed on the exterior surface of the outer tube structure.

A further embodiment of any of the foregoing embodiments may additionally and/or alternatively include the surface features comprise spiraling external flutes having a spiral with a relative angle alpha to a longitudinal axis AA of the inner tube structure being from zero degrees to 30 degrees.

In accordance with the present disclosure, there is provided An annular duct with tube-in-tube unified shell heat exchanger comprising the annular duct defined between an outer case and an inner case about an axis A; multiple tube-in-tube unified shell elements mounted to the outer case and extending into the annular duct radially relative to the axis A; each of the multiple tube-in-tube unified shell elements comprising an outer tube structure comprising a tube wall defining a first end opposite a second end; the outer tube structure comprises an interior surface and an exterior surface opposite the interior surface; the interior surface includes an augmentation structure; the outer tube structure; the outer tube structure comprises an end cap connected to the second end of the tube wall; the outer tube structure comprises a top section proximate the first end; the top section includes a flange and a flow outlet; the tube wall of the outer tube structure connects with the top section proximate the flange to form an integral outer tube structure; an inner tube structure including a tubular shaped inner body defining an internal flow area, the inner tube structure including surface features formed on the exterior of the inner tube structure; the inner tube structure including a top ring connected to the exterior proximate an inlet port of the inner tube structure; inner tube structure includes an outlet port opposite the inlet port; wherein the top ring of the inner tube structure is connected with the top section of the outer tube structure; and a gap formed between the outer tube structure and the inner tube structure, the gap fluidly coupled between the inlet port and the flow outlet.

A further embodiment of any of the foregoing embodiments may additionally and/or alternatively include the augmentation structure comprises helical shaped fins extending along the interior surface.

A further embodiment of any of the foregoing embodiments may additionally and/or alternatively include the surface features comprise external flutes that spiral along a portion of the length of the inner tube structure.

A further embodiment of any of the foregoing embodiments may additionally and/or alternatively include the augmentation structure along with the surface features are configured to provide vortex boundary mixing for an internal working fluid flowing between the exterior of the inner tube structure and interior surface of the outer tube structure.

A further embodiment of any of the foregoing embodiments may additionally and/or alternatively include the gap is configured for each of the inner tube structure and the outer tube structure to independently expand/contract responsive to thermal gradients.

A further embodiment of any of the foregoing embodiments may additionally and/or alternatively include the annular duct with tube-in-tube unified shell heat exchanger further comprising micro-fin surface features formed on the exterior surface of the outer tube structure.

In accordance with the present disclosure, there is provided a process for heat exchange through an annular duct with tube-in-tube unified shell element heat exchanger comprising flowing air through the annular duct defined between an outer case and an inner case about an axis A; mounting multiple tube-in-tube unified shell elements to the outer case extending into the annular duct radially relative to the axis A; each of the multiple tube-in-tube unified shell elements comprising an outer tube structure comprising a tube wall defining a first end opposite a second end; the outer tube structure comprises an interior surface and an exterior surface opposite the interior surface; the interior surface includes an augmentation structure; the outer tube structure; the outer tube structure comprises an end cap connected to the second end of the tube wall; the outer tube structure comprises a top section proximate the first end; the top section includes a flange and a flow outlet; the tube wall of the outer tube structure connects with the top section proximate the flange to form an integral outer tube structure; an inner tube structure including a tubular shaped inner body defining an internal flow area, the inner tube structure including surface features formed on the exterior of the inner tube structure; the inner tube structure including a top ring connected to the exterior proximate an inlet port of the inner tube structure; inner tube structure includes an outlet port opposite the inlet port; wherein the top ring of the inner tube structure is connected with the top section of the outer tube structure; a gap formed between the outer tube structure and the inner tube structure, fluidly coupling the gap between the inlet port and the flow outlet; flowing a working fluid into the inlet port through the inner tube structure; and flowing the working fluid through the gap and out of the flow outlet.

A further embodiment of any of the foregoing embodiments may additionally and/or alternatively include the process further comprising mounting the flange flush with an outer surface of the outer case.

A further embodiment of any of the foregoing embodiments may additionally and/or alternatively include the process further comprising forming vortex boundary mixing for the working fluid flowing through the gap past the augmentation structure and the surface features.

A further embodiment of any of the foregoing embodiments may additionally and/or alternatively include the process further comprising setting the end cap within an inner surface receiver of the inner case; and forming a gap between the cap and the inner surface receiver.

A further embodiment of any of the foregoing embodiments may additionally and/or alternatively include the process further comprising supplying and returning the working fluid from an exterior of the outer case.

A further embodiment of any of the foregoing embodiments may additionally and/or alternatively include the working fluid is at pressures ranging from about 1 pound per square inch to about 5000 pounds per square inch A further embodiment of any of the foregoing embodiments may additionally and/or alternatively include the working fluid is selected from the group consisting of a liquid or a supercritical fluid, air, liquid or super critical phase ammonia, liquid or super critical phase hydrogen, super critical phase carbon dioxide, and the like.

Other details of the heat exchanger are set forth in the following detailed description and the accompanying drawings wherein like reference numerals depict like elements.

DETAILED DESCRIPTION

Figure 1:
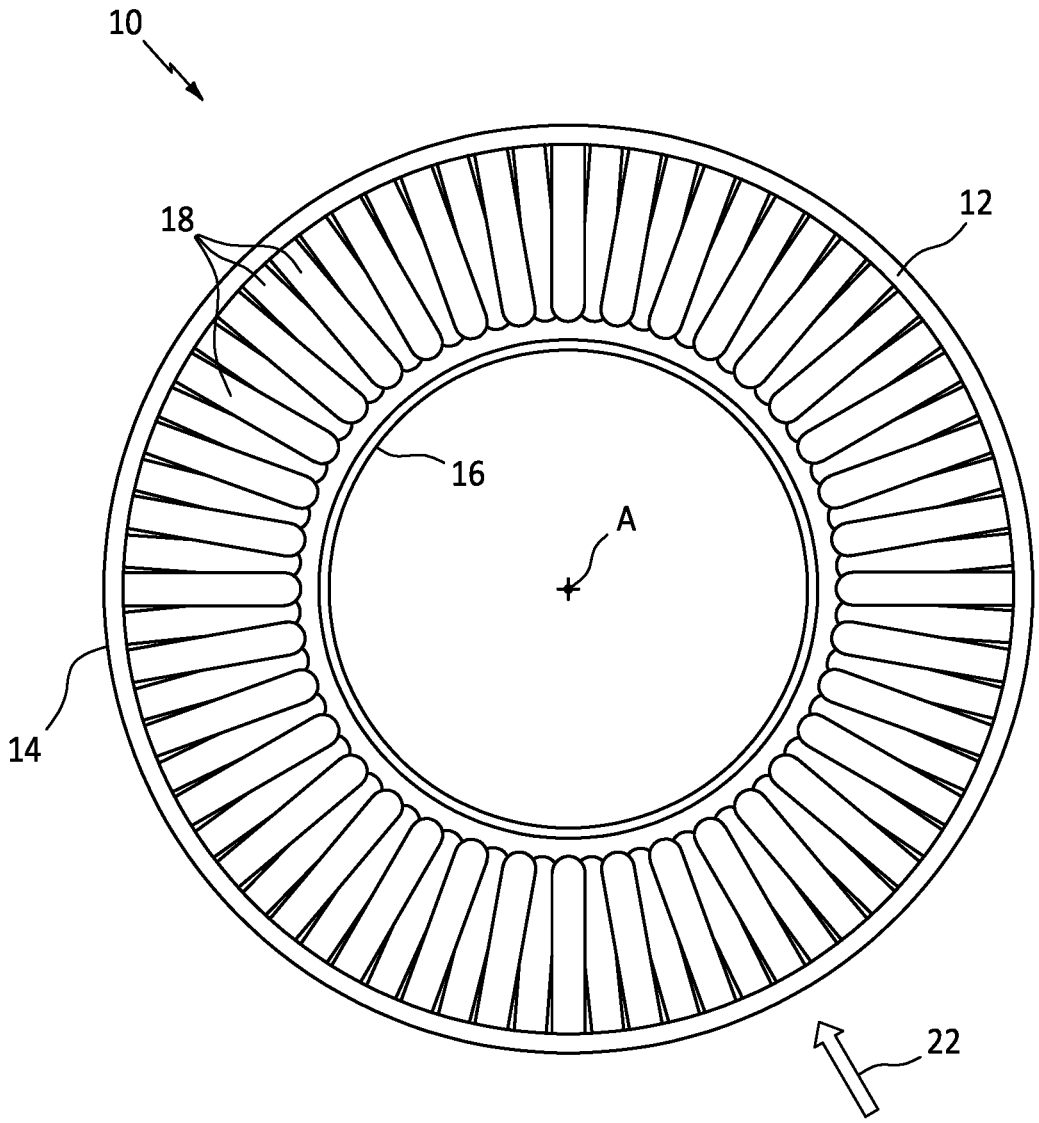
FIG. 1 is a cross sectional view of a schematic representation of an exemplary heat exchanger.
Figure 2:
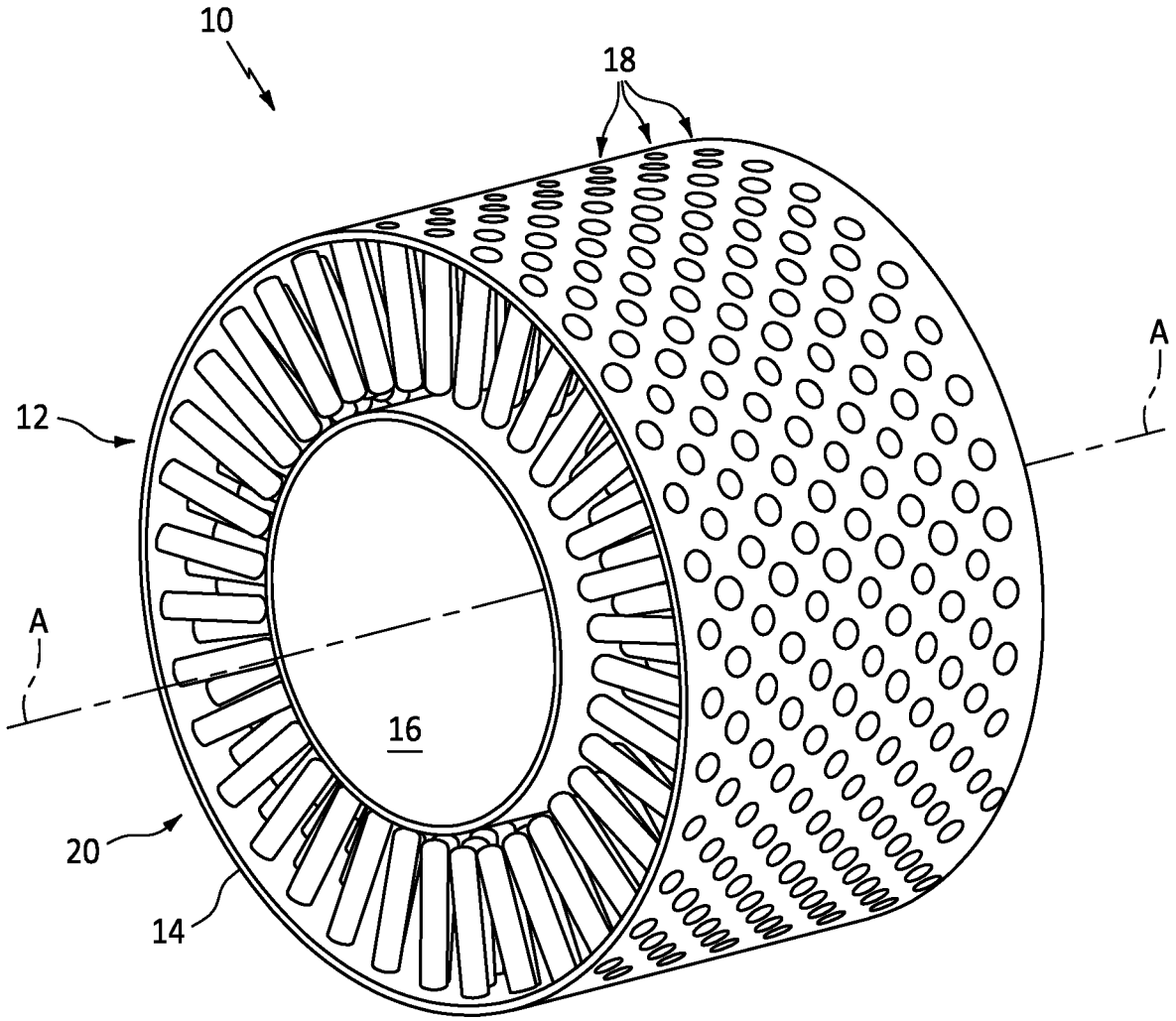
FIG. 2 is an isometric view of a schematic representation of the exemplary heat exchanger.
Figure 3:
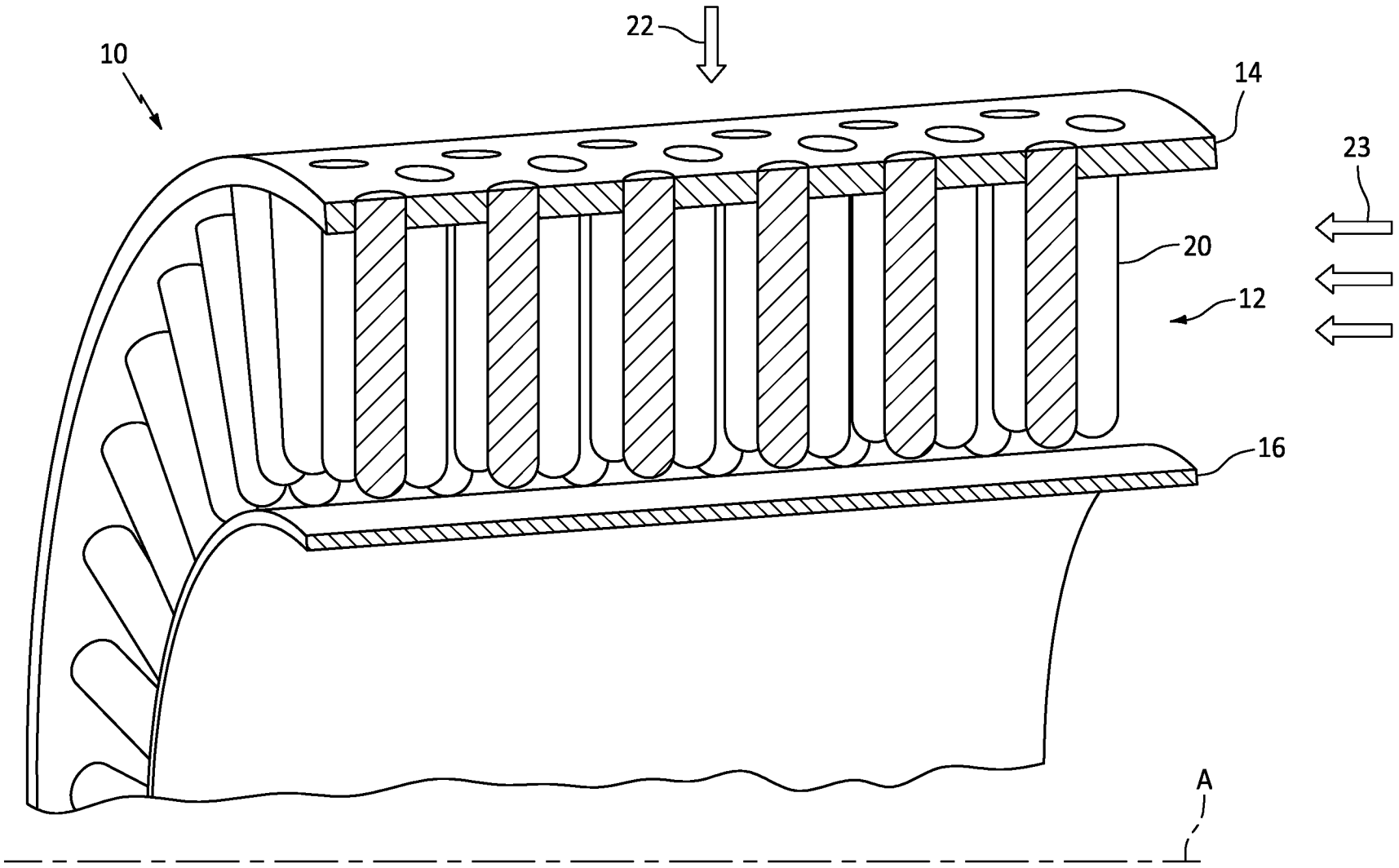
FIG. 3 is a partial cross sectional view of a schematic representation of the heat exchanger.
Figure 4:
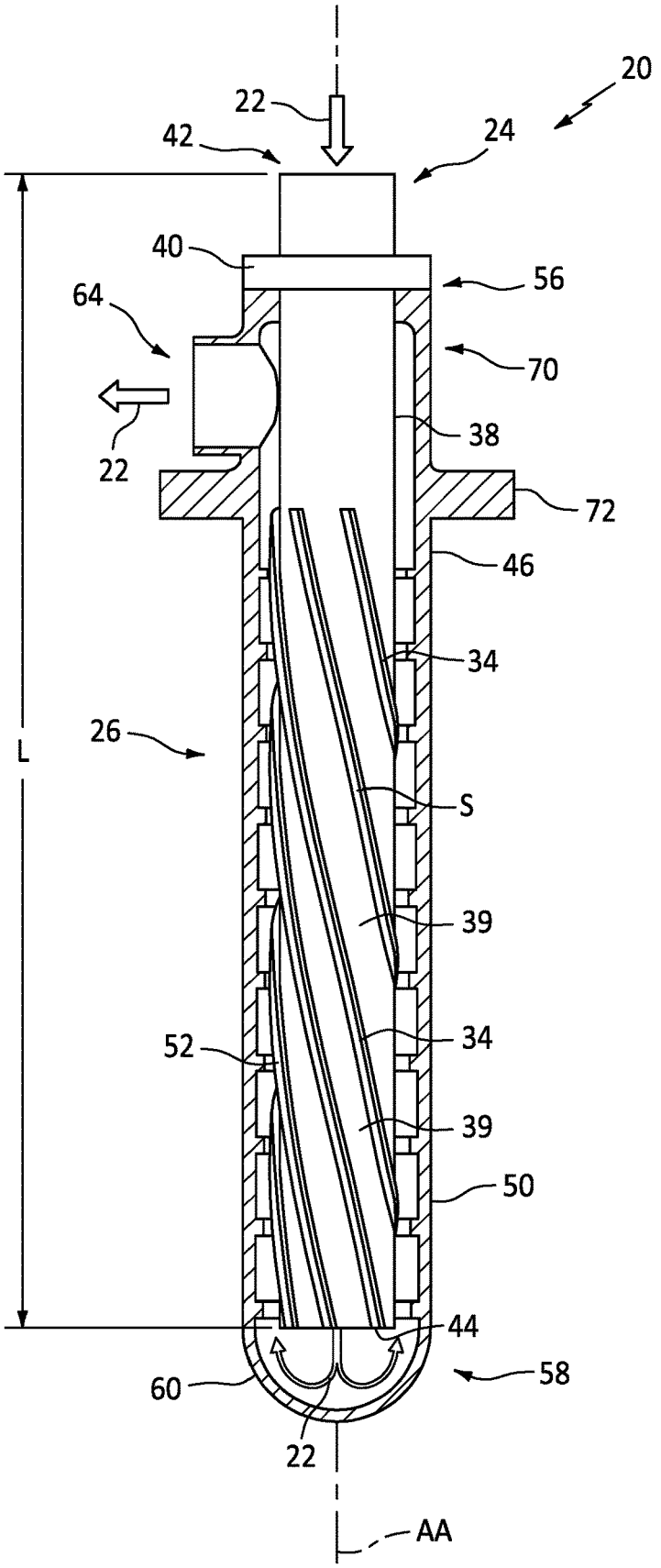
FIG. 4 is a cross-sectional view of a schematic representation of an exemplary heat exchanger element.

Referring now to FIGS. 1-3, there is illustrated an exemplary heat exchanger 10. In an exemplary embodiment, the heat exchanger 10 can be a tube-in-tube unified shell (TITUS) heat exchanger 10. The heat exchanger 10 can be installed from an exterior of an annular duct 12. The annular duct 12 can be defined between an outer case 14 enveloping an inner case 16 about an axis A. The heat exchanger 10 can include multiple small diameter tubes 18 assembled as tube-in-tube elements 20. The small diameter tubes 18 can have an outside diameter of less than 0.100 inches. An internal working fluid 22 that flows through the tube-in-tube elements 20 can include a liquid or a supercritical fluid, such as for example, air (gas), ammonia (liquid/super critical), hydrogen (liquid/super critical), carbon dioxide (super critical), and the like. An external working fluid 23, such as air can be flowing exterior of the tube elements 20, for example in an air duct of a gas turbine engine. In an exemplary embodiment, the internal working fluid 22 can be at high pressure, for example ranging from about 1 pound per square inch to about 5000 pounds per square inch.

In an exemplary embodiment, the tube elements 20 can be inserted from the exterior of the outer case 14 through the outer case 14 into the annular duct 12. This design allows for a heat exchanger 10 with an orientation and plumbing of the internal working fluid 22 to be supplied and returned from one side of the outer case 14, such as the exterior of the annular duct 12. For example, as shown, the internal working fluid 22 can be supplied and returned from exterior of the outer case 14.

Figure 5:
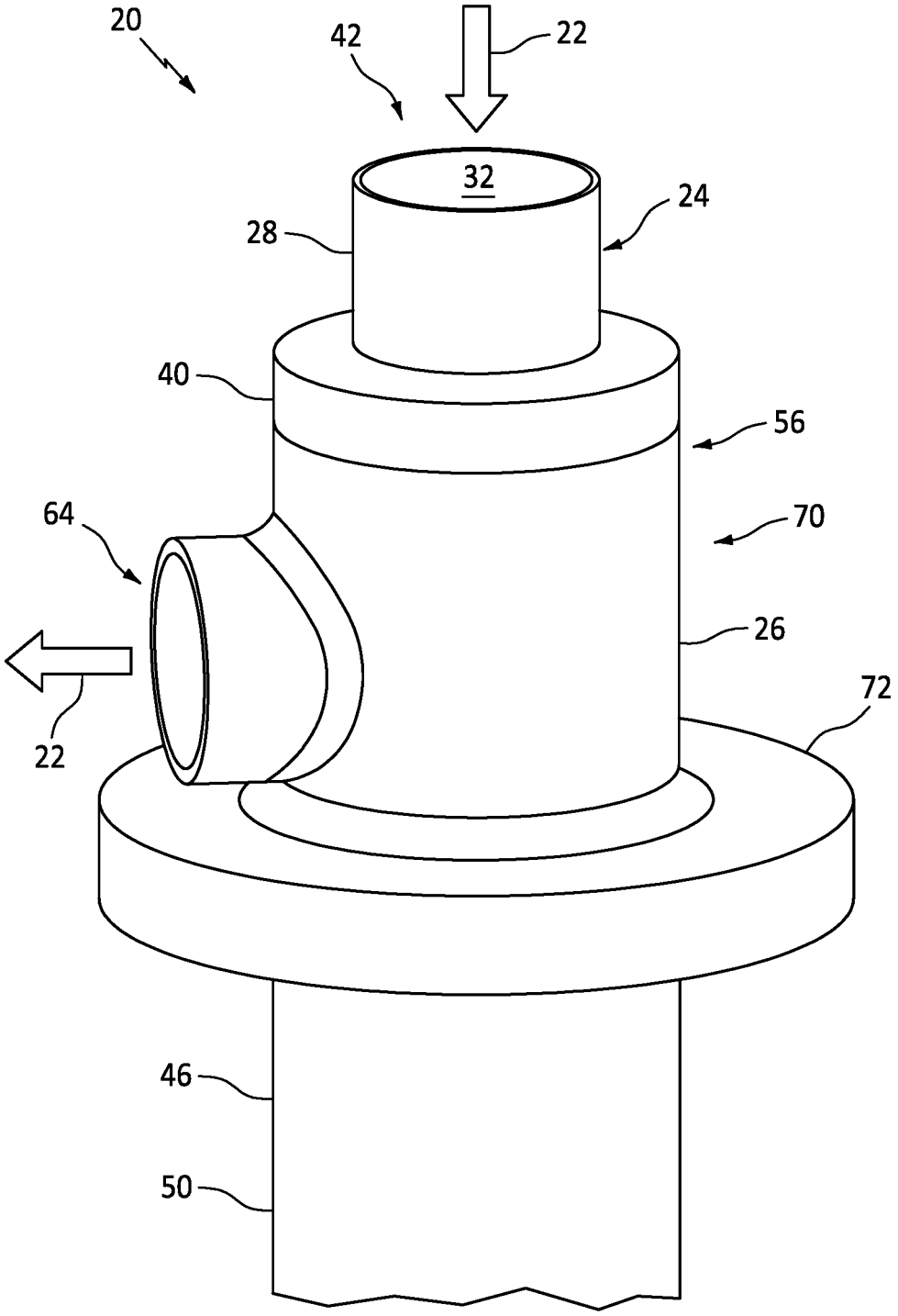
FIG. 5 is an isometric view of a schematic representation of an exemplary heat exchanger element.
Figure 6:
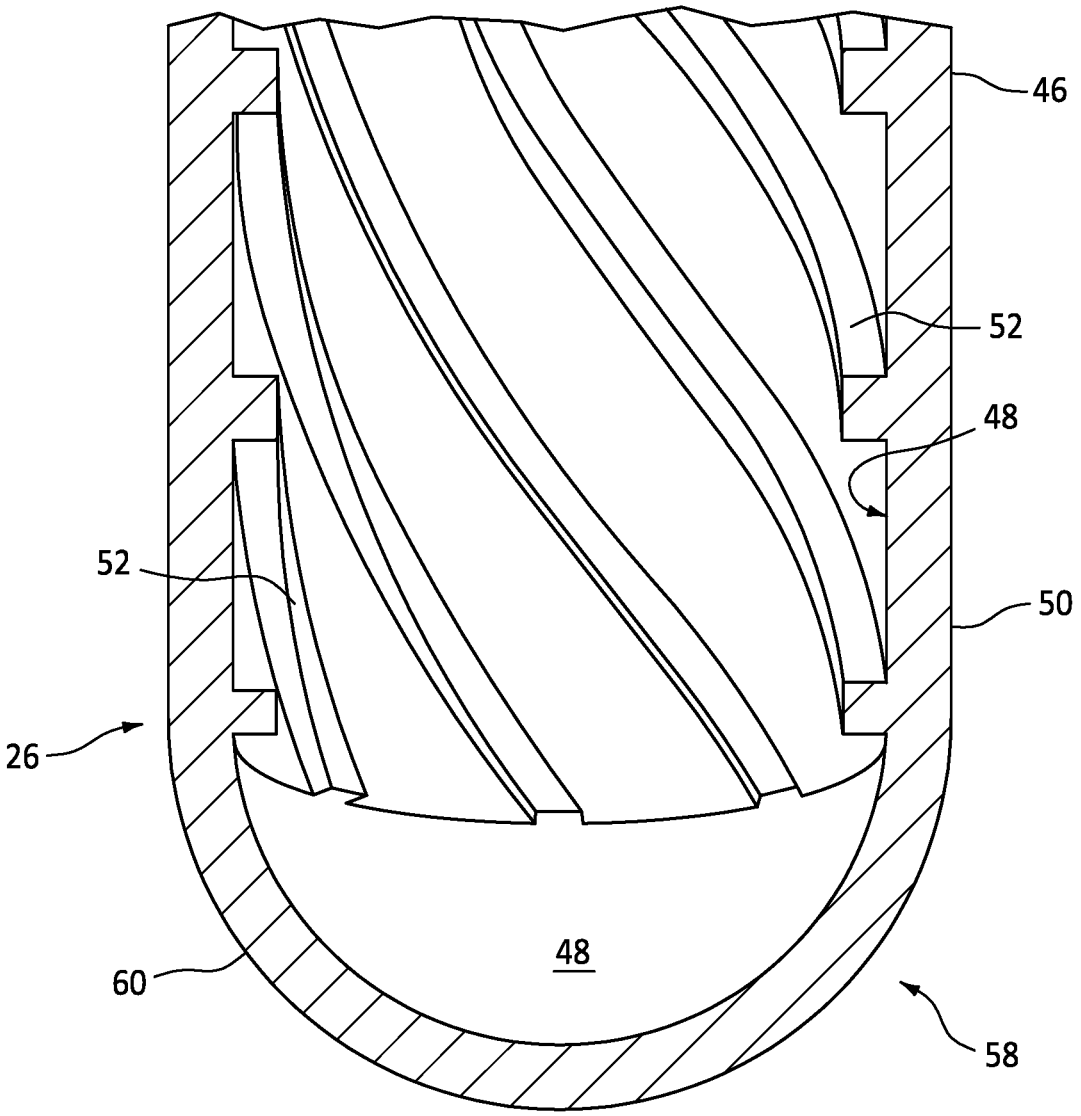
FIG. 6 is a cross-sectional view of a schematic representation of a portion of an exemplary heat exchanger element.
Figure 7:
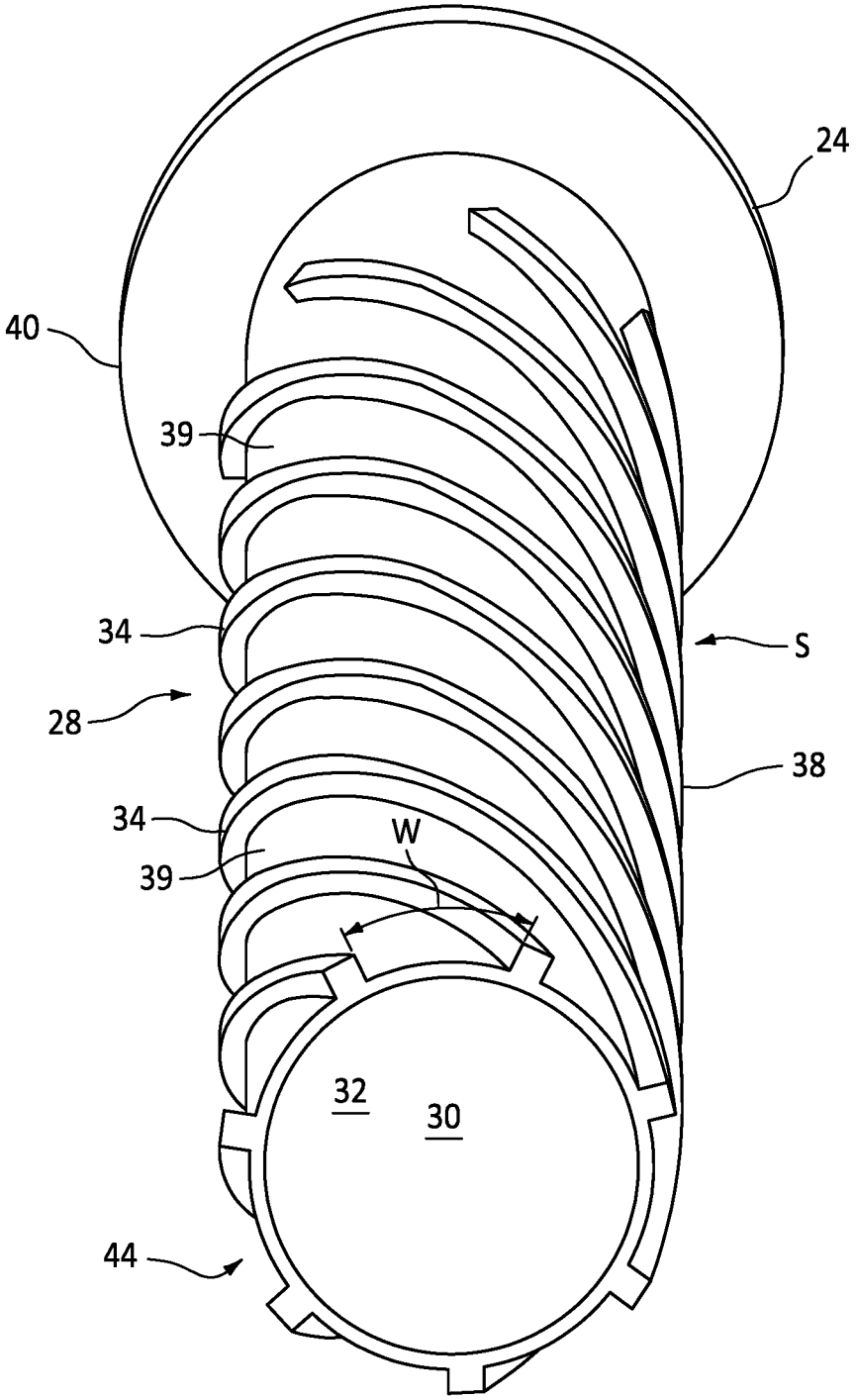
FIG. 7 is a cross-sectional view of a schematic representation of an exemplary heat exchanger element

Referring also to FIGS. 4-13, details of the tube-in-tube unified shell elements 20 are disclosed. The tube-in-tube unified shell elements or simply TITUS elements 20 include an inner tube structure 24 disposed within an outer tube structure 26. The inner tube structure 24 includes a tubular shaped inner body 28 having an internal flow area 30. In an exemplary embodiment, the internal flow area 30 can be defined by a smooth bore 32 inside diameter of the inner tube structure 24, as seen in FIGS. 5 and 7. The inner tube structure 24 includes surface features 34 disposed and/or formed on the exterior/outer diameter 38 of the inner tube structure 24. In an exemplary embodiment, the surface features 34 can be formed as external flutes or guide fins 34 that spiral along a portion of the length L of the inner tube structure 24 exposed to the working fluid. The inner tube structure 24 can be formed from thick walled tube stock. The surface features 34 can be machined into shape, such as the spiraling external flutes 34.

A flow passage 39 can be defined between any two adjacent flutes 34. The height of flow passage 39, H=(OD−ID)/2 of the annulus defined as the space between the outer tube structure 26 and inner tube structure 24, specifically, the inside diameter of the outer tube structure 26 shown at the interior surface 48 to the outside diameter 38 of the inner tube structure 24. The width W of this passage 39 is defined as the mean arc length between flutes 34, such that, the aspect ratio, AR=W/H is between 2-3. The relative angle alpha ($\alpha$) of the spiral S to the longitudinal axis AA of the inner tube structure 24 can be from about between 0 degrees (straight) and 30 degrees (see FIG. 9). The surface features 34 are configured to provide the flow passage 39 for the internal working fluid 22 flowing along the exterior of the inner tube structure 24.

The inner tube structure 24 includes a top ring 40 shaped as a cylinder configured to couple to the exterior/outer diameter 38 proximate an inlet port 42 of the inner tube structure 24. The top ring 40 facilitates connecting the inner tube structure 24 with the outer tube structure 26. The inner tube structure 24 includes an outlet port 44 opposite the inlet port 42. The internal working fluid 22 can enter the inlet port 42, flow through the internal flow area 30 and discharge from the outlet port 44 of the inner tube structure 24.

Figure 11:
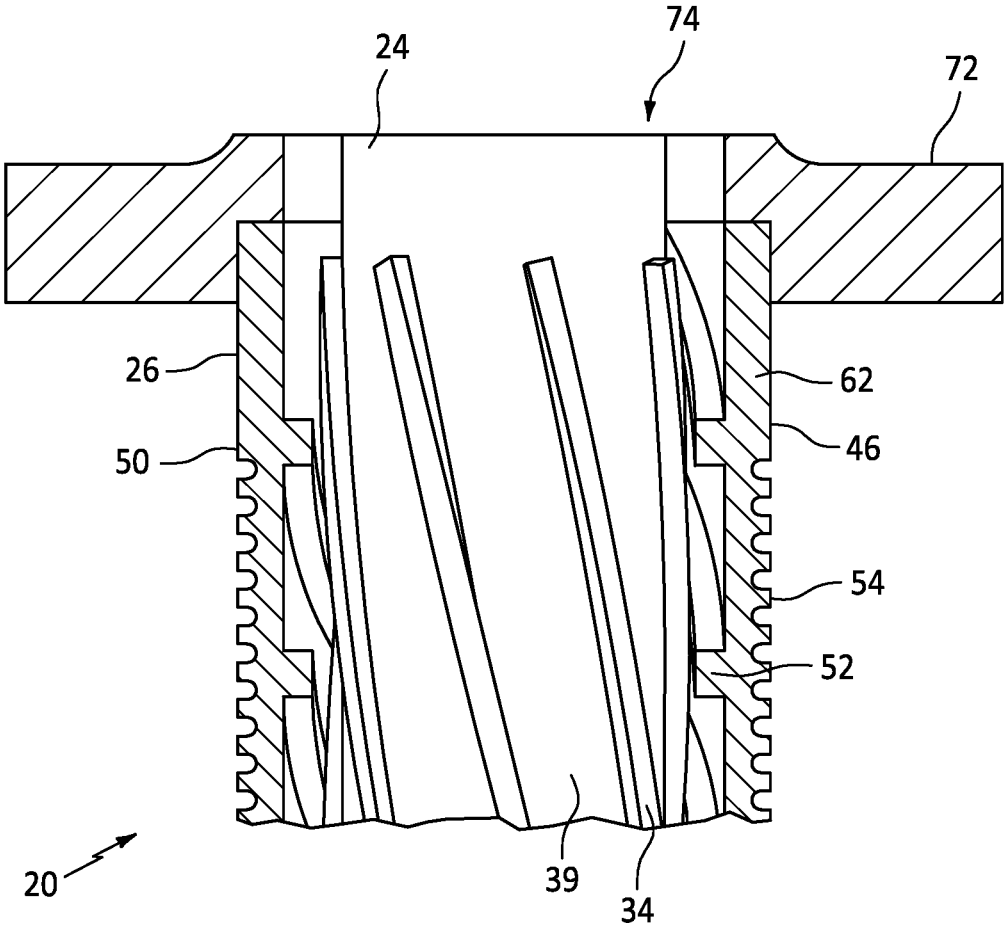
FIG. 11 is a partial cross section view of a schematic representation of a portion of an exemplary heat exchanger element.

The outer tube structure 26 includes a longitudinal cylindrical tube wall 46. The tube wall 46 of the outer tube structure 26 includes an interior surface 48 and an exterior surface 50 opposite the interior surface 48. The interior surface 48 includes an augmentation structure 52. The augmentation structure 52 can be formed as helical shaped fins that extend along the interior surface 48. The augmentation structure 52 can be formed similarly to rifling of a gun barrel, for example with a helical broaching tool to form ribs. The augmentation structure 52 can be continuous or discontinuous. The augmentation structure 52 along with the surface features 34 are configured to provide vortex boundary mixing for the internal working fluid 22 flowing between the exterior of the inner tube structure 24 and interior surface 48 of the outer tube structure 26. In an exemplary embodiment, micro-fin surface features 54 can be formed on the exterior surface 50 as seen in FIG. 11. The micro-fin surface features 54 are configured to increase the surface area of the tube wall 46 exterior surface 50. The tube wall 46 can have small diameter, or hypodermic tubing with outside diameter (OD) of less than 0.100 inch. The wall thickness can be less than or equal to 0.010 inch, and can be approximately 0.005 inch. The micro-fin surface features can have a thickness of less than or equal to 0.010 inch. In an exemplary embodiment, the micro-fin surface features 54 have a height of less than or equal to 0.003 inch. In another exemplary embodiment, the micro-fin surface features 54 can range from 0.002 inch to 0.010 inch tall. The micro-fin surface features can have a height/thickness aspect ratio (AR): 1<AR<3. In an exemplary embodiment, the materials of the tube wall 46 can include stainless steel; Inconel®, and Hastelloy®. Inconel® is a class of nickel-chrome-based super alloys characterized by high corrosion resistance, oxidation resistance, strength at high temperatures, and creep resistance. Hastelloy® is a corrosion-resistant nickel alloy that contains other chemical elements such as chromium and molybdenum. This material has high temperature resistance and exceptional corrosion resistance.

The micro-fin surface features 54 can be formed by use of forge-rolling. Cold forge-rolling is accomplished via use of a center support mandrel. Other processes can include chemical etching/machining of external surface, laser etching or conventional machining, such as on a lathe and machining via wire-EDM.

Figure 10:
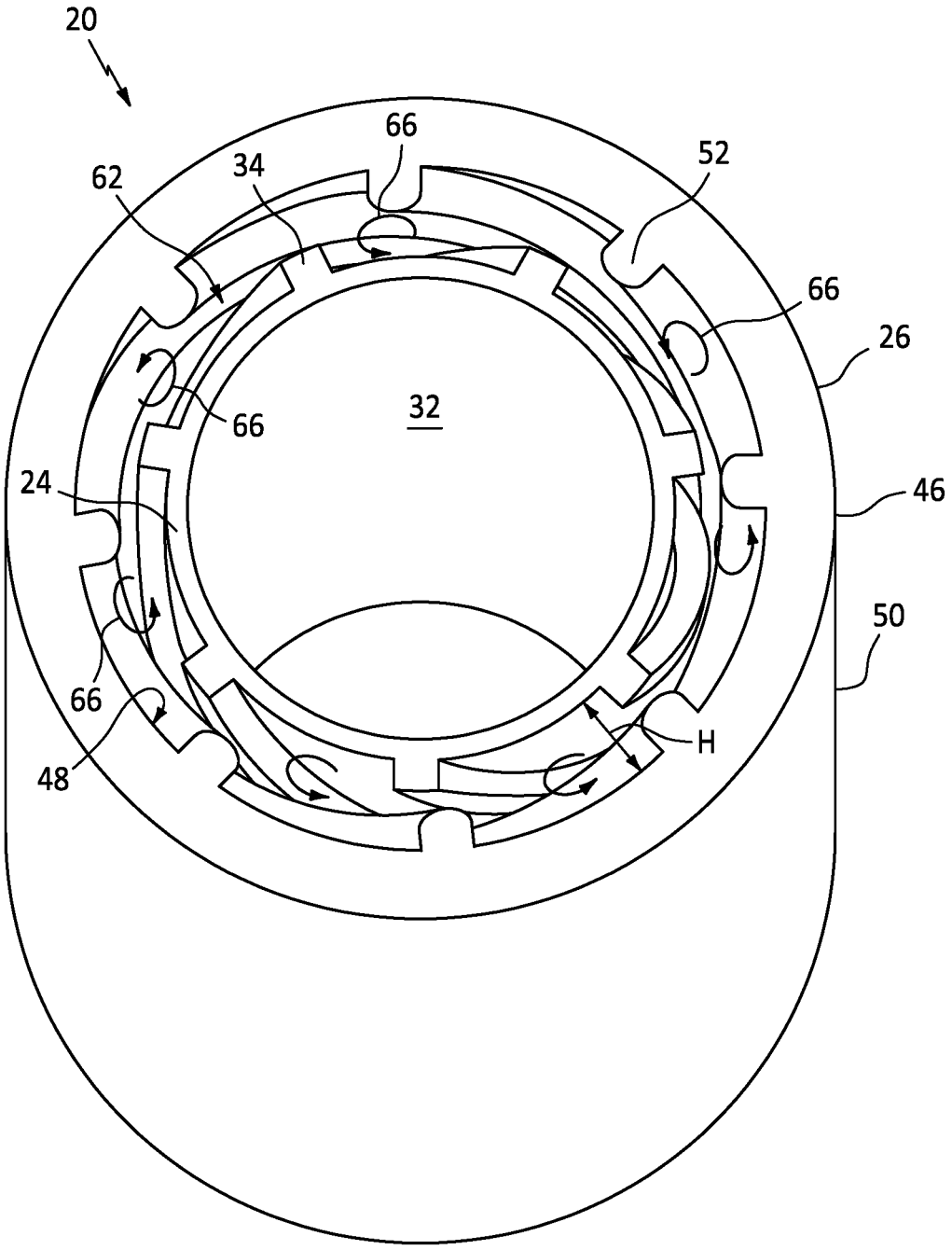
FIG. 10 is a partial cross section view of a schematic representation of a portion of an exemplary heat exchanger element.

The outer tube structure 26 includes a first end 56 opposite a second end 58. The first end 56 connects with the top ring 40 proximate the inlet port 42 of the inner tube structure 24. The second end 58 includes an end cap 60 with a hemispherical or domed shape interior surface 48. The end cap 60 is configured to turn the internal working fluid 22 after exiting the outlet port 44. The internal working fluid 22 changes direction and flows through the flow passage 39 and in part through a diametral tolerance 62 in between the inner tube structure 24 and outer tube structure 26 toward a flow outlet 64 of the outer tube structure 26. As the internal working fluid 22 flows through the flow passage 39, the internal working fluid 22 is influenced by each of the augmentation structure 52, and the surface features 34, causing the internal working fluid 22 to swirl and mix with vortex boundary mixing as depicted in FIG. 10 by arrows 66. The mixing provides for additional heat transfer between the inner tube structure 24 and the outer tube structure 26 which lessens the thermal gradient at the second end 58. The diametral tolerance 62 is configured to allow for each of the inner tube structure 24 and outer tube structure 26 to independently expand/contract responsive to thermal gradients. In an exemplary embodiment, the diametral tolerance 62 can range from 0.002 inch to 0.003 inch.

Figure 8:
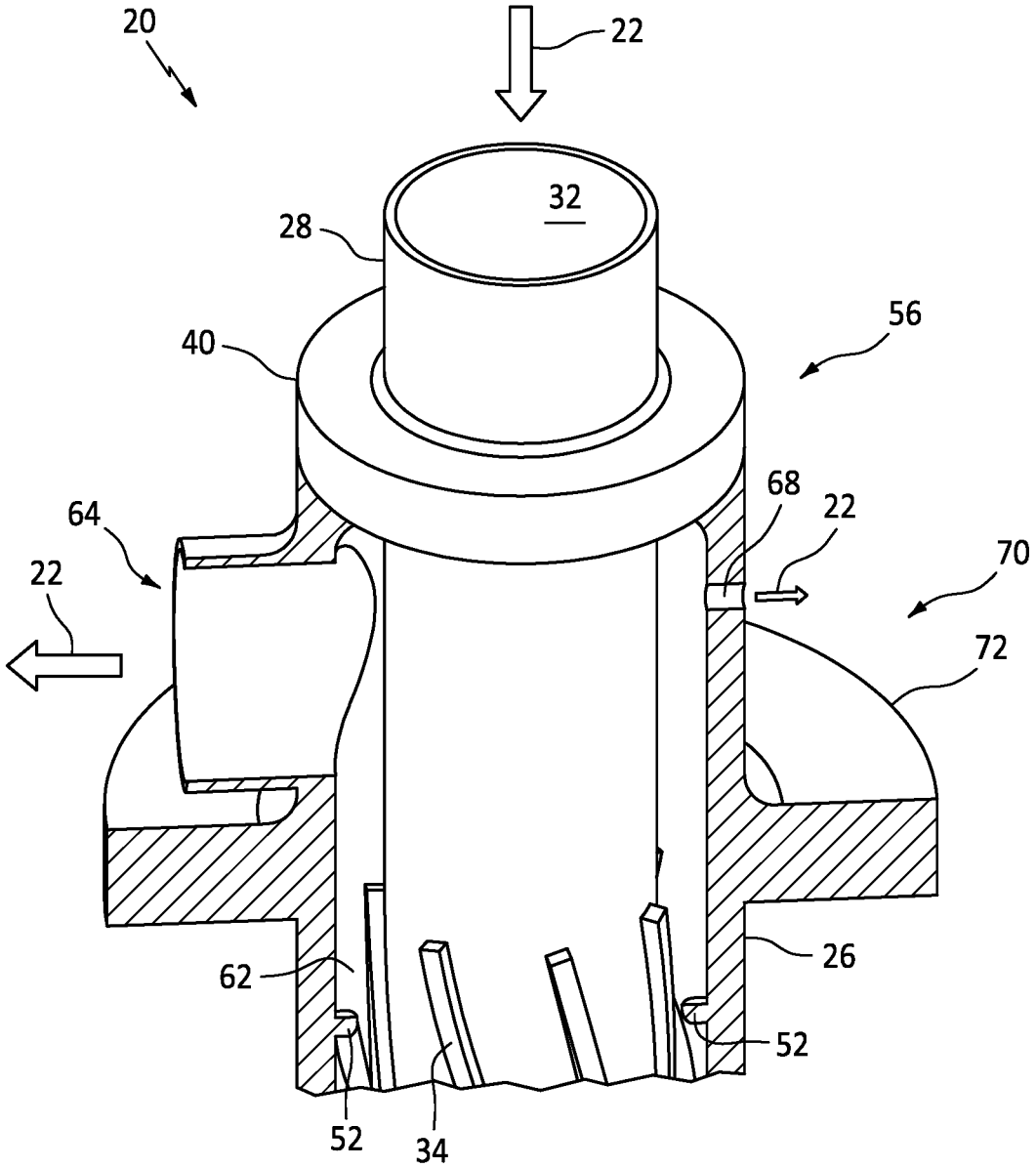
FIG. 8 is a partial cross section isometric view of a schematic representation of a portion of an exemplary heat exchanger element.
Figure 9:
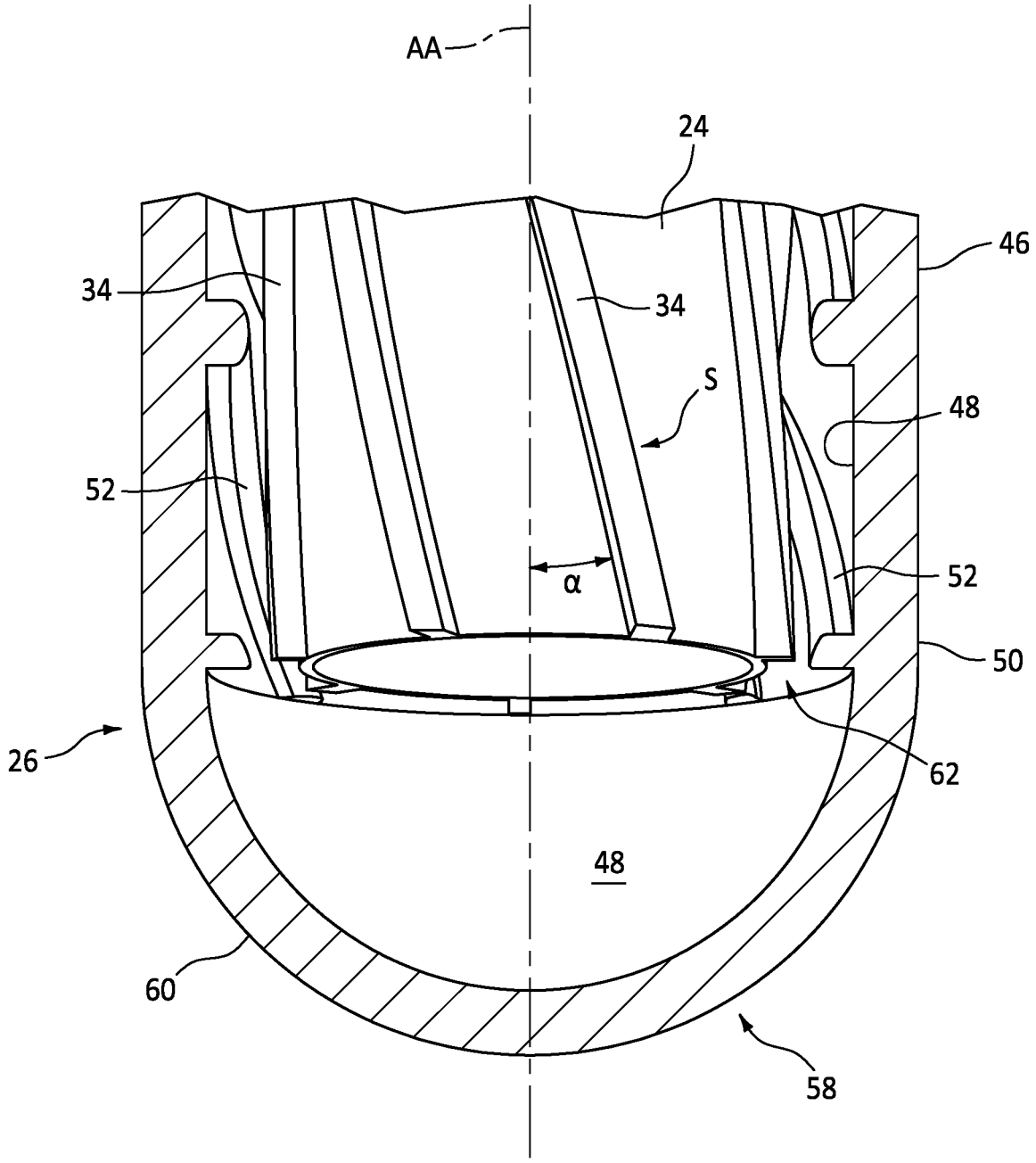
FIG. 9 is a partial cross section isometric view of a schematic representation of a portion of an exemplary heat exchanger element.

In an exemplary embodiment, the internal working fluid 22 can discharge out of the flow outlet 64 and an additional flow outlet 68 as seen in FIG. 8. The additional flow outlet 68 can be formed in the outer tube structure 26. The additional flow outlet 68 would require manifold devices to guide the internal working fluid 22.

The outer tube structure 26 includes a top section 70 proximate the first end 56. The top section 70 includes a flange 72 and the flow outlet 64. The tube wall 46 of the outer tube structure 26 connects with the top section 70 proximate the flange 72 to form the integral outer tube structure 26. The end cap 60 can be connected to the tube wall 46 of the outer tube structure 26 proximate the second end 58. The outer tube structure 26 includes a receiver 74 proximate the first end 56. The inner tube structure 24 inserts through the receiver 74 and connects with the outer tube structure 26 via the top ring 40.

The tubular body 28 of the inner tube structure 24 can be constructed of a thinner wall thickness since the inner tube structure 24 does not bear the primary loads created by the gas turbine annular duct fluid flow 23. When the aerodynamic loads applied by the external working fluid 23 to the outer case 14 cause deflection, the inner case 16 and outer case 14 structures will come into contact. The interaction between them will form a reinforcement, hence the term unified shell. The inner case 16 structure may be a load bearing structure.

Figure 12:
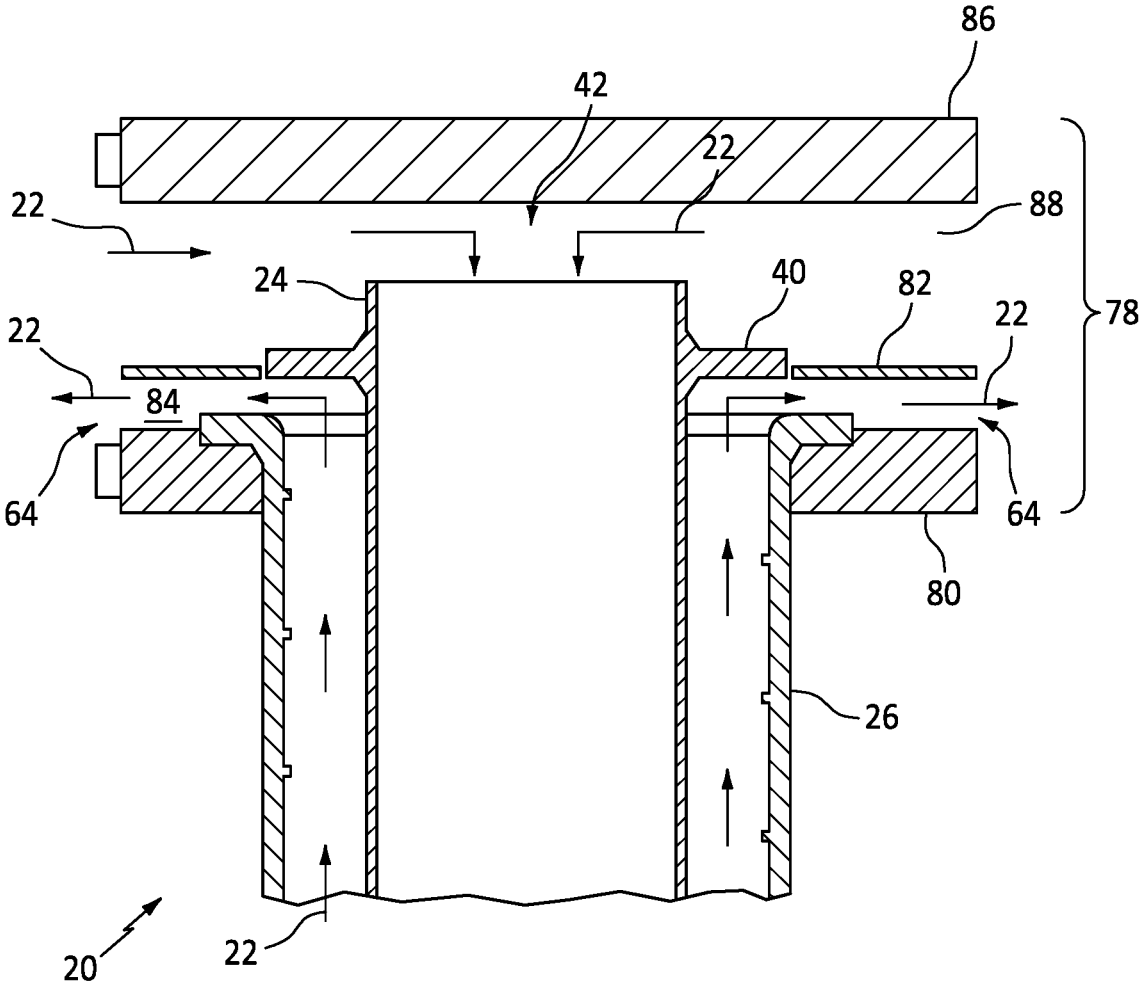
FIG. 12 is a partial cross section isometric view of a schematic representation of a portion of an exemplary heat exchanger.

In an exemplary embodiment, as seen in FIG. 12, a multi-layered manifold 78 can be employed to direct the internal working fluid 22. The multi-layered manifold 78 can include an inner manifold 80 that connects with the outer tube structure 26. A middle manifold 82 is connected with the top ring 40 forming a first flow space 84 for the flow outlet 64 and the discharge of the internal working fluid 22. An outer manifold 86 is located to form a second flow space 88 fluidly coupled to the inlet port 42, for the ingress of the internal working fluid 22.

Figure 13:
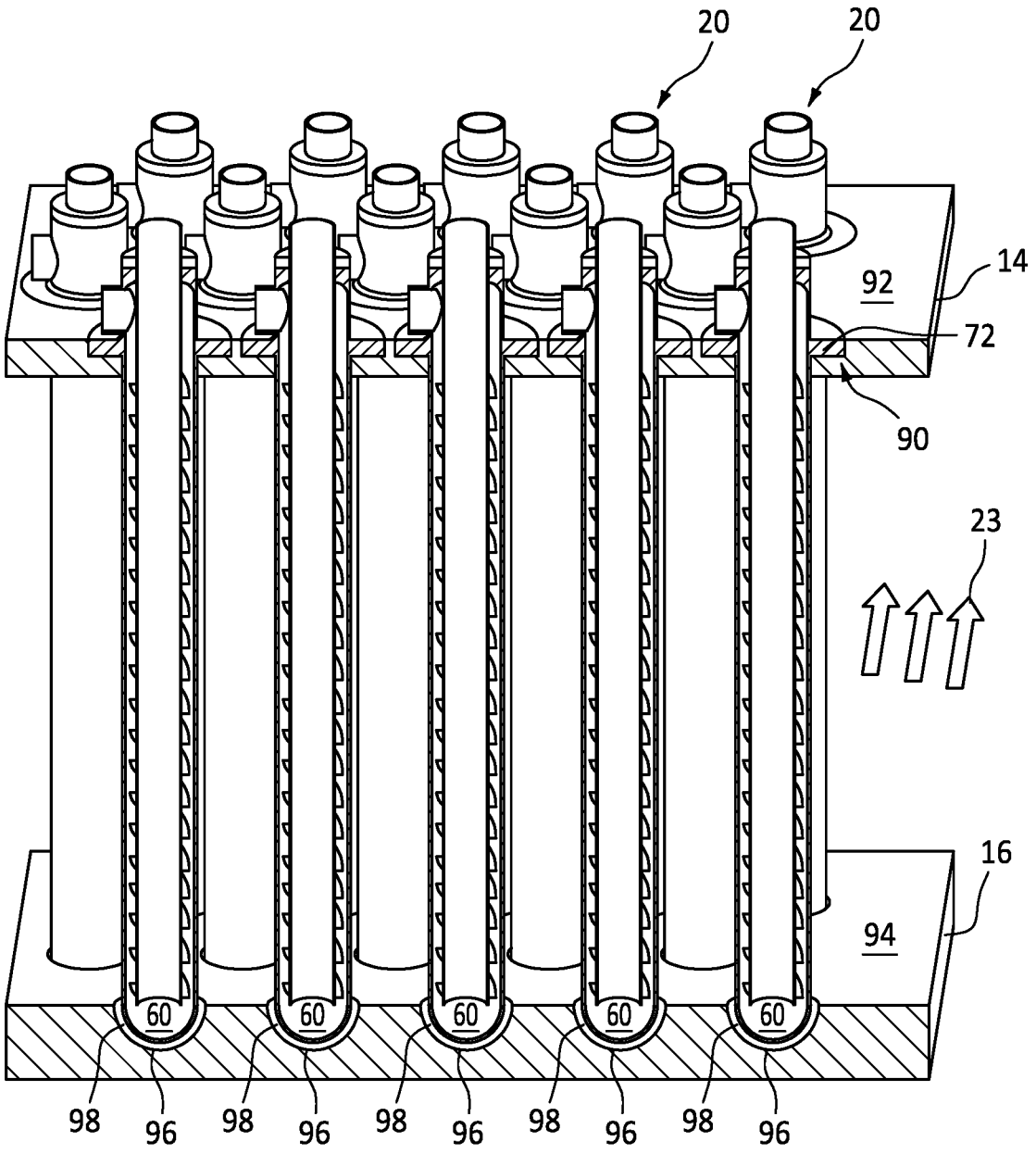
FIG. 13 is a partial cross section isometric view of a schematic representation of a portion of an exemplary heat exchanger element.

FIG. 13 includes a partial cross section view of multiple TITUS elements 20 mounted in the outer case 14. The TITUS element 20 can be seen with the flange 72 connected with the outer case 14 in a counter bored portion 90. The counter bored portion 90 allows for the flange 72 to be set flush with an outer surface 92 of the outer case 14. The inner case 16 includes an inner surface 94. The inner surface 94 includes an inner surface receiver 96 for each of the TITUS elements 20. The receiver 96 allows for the end cap 60 to set within the inner surface receiver 96. There can be a gap 98 between the cap 60 and the inner surface receiver 96. The gap 98 can be from about 10 mil to about 12 mil. The gap 98 allows for thermal expansion of the TITUS element 20 and still provides for support to resist vibration from the flow forces of the external working fluid 23, such as gas turbine fluid flow during use.

A technical advantage of the disclosed heat exchanger includes a double-walled tube structure, making the TITUS element structurally stiff.

Another technical advantage of the disclosed heat exchanger includes fluid entering from the top, through the inner tube, to the bottom; at the bottom, the fluid travels up between the inner and outer tubes.

Another technical advantage of the disclosed heat exchanger includes inside the annular passage are turbulator ribs that enhance heat transfer.

Another technical advantage of the disclosed heat exchanger includes processed flow is collected at the top; hence, fluid enters and exits from the same end of the tube structure.

Another technical advantage of the disclosed heat exchanger includes the outer tube contains forge rolled fins, or threads, to increase surface area and heat transfer.

Another technical advantage of the disclosed heat exchanger includes TITUS elements having free floating ends allowing for thermal expansion, unlike conventional tube-style heat exchangers having the tubes fixed at both ends, requiring some means of compliance to alleviate thermal strain.

Another technical advantage of the disclosed heat exchanger includes the TITUS element allows for simple assembly and plumbing, without the need of complex manifolds.

Another technical advantage of the disclosed heat exchanger includes the entire TITUS element, and its internal components, are allowed to grow radially without inducing thermal strain.

Another technical advantage of the disclosed heat exchanger includes the TITUS element is simply supported with a slip-fitting.

Another technical advantage of the disclosed heat exchanger includes TITUS elements are compact allowing for multiple end use such as for oil coolers or fuel cooling and used as immersive heaters/coolers.

There has been provided a heat exchanger. While the heat exchanger has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A tube-in-tube unified shell element heat exchanger comprising:

an outer tube structure comprising a tube wall defining a first end opposite a second end; the outer tube structure comprises an interior surface and an exterior surface opposite the interior surface; the interior surface includes an augmentation structure; the outer tube structure comprises an end cap connected to the second end of the tube wall; the outer tube structure comprises a top section proximate the first end; the top section includes a flange and a flow outlet; the tube wall of the outer tube structure connects with the top section proximate the flange to form an integral outer tube structure;

an inner tube structure including a tubular shaped inner body defining an internal flow area, the inner tube structure including surface features formed on the exterior of the inner tube structure; the inner tube structure including a top ring connected to the exterior proximate an inlet port of the inner tube structure; inner tube structure includes an outlet port opposite the inlet port; wherein the top ring of the inner tube structure is connected with the top section of the outer tube structure; and a gap formed between the outer tube structure and the inner tube structure, the gap fluidly coupled between the inlet port and the flow outlet.

2. The tube-in-tube unified shell element heat exchanger according to claim 1, wherein said augmentation structure comprises helical shaped fins extending along the interior surface.

3. The tube-in-tube unified shell element heat exchanger according to claim 1, wherein the surface features comprise external flutes that spiral along a portion of the length of the inner tube structure.

4. The tube-in-tube unified shell element heat exchanger according to claim 1, wherein the augmentation structure along with the surface features are configured to provide vortex boundary mixing for an internal working fluid flowing between the exterior of the inner tube structure and interior surface of the outer tube structure.

5. The tube-in-tube unified shell element heat exchanger according to claim 1, wherein the gap is configured for each of the inner tube structure and the outer tube structure to independently expand/contract responsive to thermal gradients.

6. The tube-in-tube unified shell element heat exchanger according to claim 1, further comprising:

micro-fin surface features formed on the exterior surface of the outer tube structure.

7. The tube-in-tube unified shell element heat exchanger according to claim 1, wherein the surface features comprise spiraling external flutes having a spiral with a relative angle alpha to a longitudinal axis AA of the inner tube structure being from zero degrees to 30 degrees.

8. An annular duct with tube-in-tube unified shell heat exchanger comprising:

the annular duct defined between an outer case and an inner case about an axis A;

multiple tube-in-tube unified shell elements mounted to the outer case and extending into the annular duct radially relative to the axis A;

each of the multiple tube-in-tube unified shell elements comprising:

an outer tube structure comprising a tube wall defining a first end opposite a second end; the outer tube structure comprises an interior surface and an exterior surface opposite the interior surface; the interior surface includes an augmentation structure; the outer tube structure; the outer tube structure comprises an end cap connected to the second end of the tube wall; the outer tube structure comprises a top section proximate the first end; the top section includes a flange and a flow outlet; the tube wall of the outer tube structure connects with the top section proximate the flange to form an integral outer tube structure;

an inner tube structure including a tubular shaped inner body defining an internal flow area, the inner tube structure including surface features formed on the exterior of the inner tube structure; the inner tube structure including a top ring connected to the exterior proximate an inlet port of the inner tube structure; inner tube structure includes an outlet port opposite the inlet port; wherein the top ring of the inner tube structure is connected with the top section of the outer tube structure; and a gap formed between the outer tube structure and the inner tube structure, the gap fluidly coupled between the inlet port and the flow outlet.

9. The annular duct with tube-in-tube unified shell heat exchanger according to claim 8, wherein the augmentation structure comprises helical shaped fins extending along the interior surface.

10. The annular duct with tube-in-tube unified shell heat exchanger according to claim 8, wherein the surface features comprise external flutes that spiral along a portion of the length of the inner tube structure.

11. The annular duct with tube-in-tube unified shell heat exchanger according to claim 8, wherein the augmentation structure along with the surface features are configured to provide vortex boundary mixing for an internal working fluid flowing between the exterior of the inner tube structure and interior surface of the outer tube structure.

12. The annular duct with tube-in-tube unified shell heat exchanger according to claim 8, wherein the gap is configured for each of the inner tube structure and the outer tube structure to independently expand/contract responsive to thermal gradients.

13. The annular duct with tube-in-tube unified shell heat exchanger according to claim 8, further comprising:

micro-fin surface features formed on the exterior surface of the outer tube structure.

14. A process for heat exchange through an annular duct with tube-in-tube unified shell element heat exchanger comprising:

flowing air through the annular duct defined between an outer case and an inner case about an axis A;

mounting multiple tube-in-tube unified shell elements to the outer case extending into the annular duct radially relative to the axis A;

each of the multiple tube-in-tube unified shell elements comprising:

an outer tube structure comprising a tube wall defining a first end opposite a second end; the outer tube structure comprises an interior surface and an exterior surface opposite the interior surface; the interior surface includes an augmentation structure; the outer tube structure; the outer tube structure comprises an end cap connected to the second end of the tube wall; the outer tube structure comprises a top section proximate the first end; the top section includes a flange and a flow outlet; the tube wall of the outer tube structure connects with the top section proximate the flange to form an integral outer tube structure;

an inner tube structure including a tubular shaped inner body defining an internal flow area, the inner tube structure including surface features formed on the exterior of the inner tube structure; the inner tube structure including a top ring connected to the exterior proximate an inlet port of the inner tube structure; inner tube structure includes an outlet port opposite the inlet port; wherein the top ring of the inner tube structure is connected with the top section of the outer tube structure;

a gap formed between the outer tube structure and the inner tube structure, fluidly coupling the gap between the inlet port and the flow outlet;

flowing a working fluid into the inlet port through the inner tube structure; and flowing the working fluid through the gap and out of the flow outlet.

15. The process of claim 14, further comprising:

mounting the flange flush with an outer surface of the outer case.

16. The process of claim 14, further comprising:

forming vortex boundary mixing for the working fluid flowing through the gap past the augmentation structure and the surface features.

17. The process of claim 14, further comprising:

setting the end cap within an inner surface receiver of the inner case; and forming a gap between the cap and the inner surface receiver.

18. The process of claim 14, further comprising:

supplying and returning the working fluid from an exterior of the outer case.

19. The process of claim 14, wherein the working fluid is at pressures ranging from about 1 pound per square inch to about 5000 pounds per square inch.

20. The process of claim 14, wherein said working fluid is selected from the group consisting of a liquid or a supercritical fluid, air, liquid or super critical phase ammonia, liquid or super critical phase hydrogen, super critical phase carbon dioxide, and the like.

* * * * *